US008764184B2

(12) United States Patent
Yamanobe et al.

(10) Patent No.: US 8,764,184 B2
(45) Date of Patent: Jul. 1, 2014

(54) IMAGE FORMING DEVICE

(75) Inventors: Jun Yamanobe, Kanagawa (JP); Tsutomu Kato, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 68 days.

(21) Appl. No.: 13/531,605

(22) Filed: Jun. 25, 2012

(65) Prior Publication Data

US 2013/0010032 A1 Jan. 10, 2013

(30) Foreign Application Priority Data

Jul. 5, 2011 (JP) ..... 2011-149238

(51) Int. Cl.
*B41J 2/01* (2006.01)

(52) U.S. Cl.
USPC ..... 347/104; 347/101

(58) Field of Classification Search
None
See application file for complete search history.

(56) References Cited

U.S. PATENT DOCUMENTS

| | | | | |
|---|---|---|---|---|
| 7,524,050 | B2 * | 4/2009 | Baker et al. | 347/104 |
| 2010/0200165 | A1 * | 8/2010 | Lerner et al. | 156/379 |

FOREIGN PATENT DOCUMENTS

| | | |
|---|---|---|
| JP | 1-58546 | 4/1989 |
| JP | 10-250882 A | 9/1989 |
| JP | 3-240071 | 10/1991 |
| JP | 2005-15184 | 1/2005 |

OTHER PUBLICATIONS

Partial English language translation of the following: Office action dated Apr. 23, 2013 from the Japanese Patent Office in a Japanese patent application corresponding to the instant patent application. This office action translation is submitted now in order to supplement the understanding of patent document JP 3-240071, JP2005-15184 and JP1-58546 which are cited in the office action and are being disclosed in the instant Information Disclosure Statement.

* cited by examiner

*Primary Examiner* — Geoffrey Mruk
(74) *Attorney, Agent, or Firm* — SOLARIS Intellectual Property Group, PLLC

(57) ABSTRACT

An image forming device has: a supporting/conveying member that supports a sheet-shaped recording medium from a bottom surface of the recording medium, and conveys the recording medium while rotating; an abutment member that abuts a leading end portion of the recording medium and stops the leading end portion of the recording medium; and a pushing roller that is provided at an upstream side in a conveying direction of the recording medium so as to face the supporting/conveying member, and pushes the leading end portion of the recording medium against the abutment member by rotating while contacting the recording medium and sliding on the recording medium.

15 Claims, 10 Drawing Sheets

IMAGE FORMING DEVICE

CROSS-REFERENCE TO RELATED APPLICATION

This application claims priority under 35 USC 119 from Japanese Patent Application No. 2011-149238, filed on Jul. 5, 2011, the disclosure of which is incorporated by reference herein.

BACKGROUND OF THE INVENTION

1. Field of the Invention

The present invention relates to an image forming device that ejects droplets onto a recording medium and forms an image.

2. Description of the Related Art

Japanese Patent Application Laid-Open (JP-A) No. 10-250882 discloses an endless belt (conveying belt) that feeds-out sheets (recording media), that are stacked in a paper stacking section, to a downstream side in a sheet conveying direction.

Due to the leading end portion of a sheet, that is conveyed while placed on the endless belt that circulates, being thrust-against an abutment member, the leading end portion of the sheet is registered. Further, a conveying roller, that conveys a sheet by abutting the endless belt (conveying belt) and being slave-rotated thereby, is provided. The conveying roller is disposed further toward the upstream side in the sheet conveying direction than the trailing end portion of the sheet whose leading end portion is thrust-against the abutment member.

However, in the conventional art, the conveying roller is disposed further toward the upstream side in the direction of conveying the recording media, than the trailing end portion of a recording medium whose leading end portion is thrust-against the abutment member. Further, the power at the time when the leading end portion of the recording medium hits the abutment member is only the conveying force of the conveying belt. Therefore, if the recording medium is wavy, there are cases in which the recording medium tilts when a portion of the leading end portion thereof hits the abutment member.

SUMMARY OF THE INVENTION

The present invention overcomes the aforementioned problem by causing a recording medium to hit an abutment member at a proper posture, even if the recording medium is wavy.

An image forming device relating to a first aspect of the present invention has: a supporting/conveying member that supports a sheet-shaped recording medium from a bottom surface of the recording medium, and conveys the recording medium while rotating; an abutment member that abuts a leading end portion of the recording medium that is conveyed by the supporting/conveying member, and stops the leading end portion of the recording medium; a pushing roller that is provided at an upstream side, in a conveying direction of the recording medium, with respect to the abutment member so as to face the supporting/conveying member, and pushes the leading end portion of the recording medium against the abutment member by rotating while contacting the recording medium and sliding on the recording medium; a conveying member that conveys the recording medium, whose stopped state by the abutment member has been released, toward a downstream side in the conveying direction of the recording medium; and a droplet ejecting head that ejects droplets onto the recording medium that is conveyed by the conveying member, and forms an image on the recording medium.

In accordance with the above-described structure, while contacting the recording medium, the pushing roller rotates, and pushes the leading end portion of the recording medium against the abutment member. Due to the pushing roller pushing the leading end portion of the recording medium against the abutment member in this way, the recording medium can abut the abutment member at the proper posture, even when the recording medium is wavy.

In an image forming device relating to a second aspect of the present invention, the image forming device of the above-described first aspect has an adjusting mechanism that adjusts nipping force by which the recording medium is nipped between the pushing roller and the supporting/conveying member.

In accordance with the above-described structure, the adjusting mechanism adjusts the nipping force by which the recording medium is nipped between the pushing roller and the supporting/conveying member. Therefore, the pushing force, by which the pushing roller pushes the leading end portion of the recording medium against the abutment member, becoming excessive can be suppressed.

In an image forming device relating to a third aspect of the present invention, in the image forming device relating to the second aspect, the adjusting mechanism structures the pushing roller, and is plural flexible elongated members that spread-out in a radial form in a radial direction from a rotating shaft of the pushing roller.

In accordance with the above-described structure, the plural flexible elongated members, that spread-out in a radial form in the radial direction from the rotational center of the pushing roller, hit the recording medium and flex. Due thereto, the nipping force by which the recording medium is nipped can be adjusted.

In an image forming device relating to a fourth aspect of the present invention, in the image forming device relating to the second aspect, the adjusting mechanism is an elastic member that supports a rotating shaft of the pushing roller while expanding and contracting such that the pushing roller approaches or moves away from the supporting/conveying member.

In accordance with the above-described structure, the elastic member supports the rotating shaft of the pushing roller while expanding and contracting such that the pushing roller approaches or moves away from the supporting/conveying member. Due thereto, the nipping force by which the recording medium is nipped can be adjusted.

In an image forming device relating to a fifth aspect of the present invention, in the image forming device relating to the second aspect, the adjusting mechanism is an interval adjusting member that moves a rotating shaft of the pushing roller and adjusts an interval between the supporting/conveying member and the pushing roller.

In accordance with the above-described structure, the interval adjusting member moves the rotating shaft of the pushing roller and adjusts the interval between the supporting/conveying member and the pushing roller. Due thereto, the nipping force by which the recording medium is nipped can be adjusted.

In an image forming device relating to a sixth aspect of the present invention, the image forming device relating to any one of the first through fifth aspects has a drive source that imparts rotational force to a rotating shaft of the pushing roller and rotates the pushing roller.

In accordance with the above-described structure, because the drive source imparts rotational force to the rotating shaft of the pushing roller and rotates the pushing roller, the recording medium can effectively hit the abutment member at the proper posture.

In an image forming device relating to a seventh aspect of the present invention, the image forming device relating to the sixth aspect has: a conveying roller that is disposed at an upstream side, in the conveying direction of the recording medium, with respect to a trailing end portion of a recording medium whose leading end portion abuts the abutment member, and that rotates, and conveys the recording medium along a conveying path of the recording medium; and a transmission member that transfers rotational force of the conveying roller to the pushing roller.

In accordance with the above-described structure, because the rotational force of the conveying roller is transferred to the pushing roller by the transmission member, the pushing roller can be rotated without providing a drive source used exclusively for rotating the pushing roller.

In an image forming device relating to an eighth aspect of the present invention, the image forming device relating to the seventh aspect has a supporting mechanism that supports the pushing roller such that the pushing roller is, by its own weight, pushed against the supporting/conveying member.

In accordance with the above-described structure, the supporting mechanism supports the pushing roller such that the pushing roller is, by its own weight, pushed against the supporting/conveying member. Therefore, excessive nipping force (the nipping force by which the recording medium is nipped) being generated between the pushing roller and the supporting/conveying member can be suppressed.

In an image forming device relating to a ninth aspect of the present invention, in the image forming device relating to the eighth aspect, the supporting mechanism is a supporting member that, when viewed from a direction of a rotating shaft of the conveying roller, supports the pushing roller swingably with respect to the conveying roller.

In accordance with the above-described structure, the supporting member supports the pushing roller swingably with respect to the conveying roller. Therefore, excessive nipping force being generated between the pushing roller and the supporting/conveying member can be suppressed effectively.

In an image forming device relating to a tenth aspect of the present invention, in the image forming device relating to the any one of the seventh through ninth aspects, the conveying roller rotates by being slave-driven with respect to the supporting/conveying member.

In accordance with the above-described structure, the conveying roller rotates by being slave-driven with respect to the supporting/conveying member that circulates. Therefore, the conveying roller can be rotated without providing a drive source used exclusively for rotating the conveying roller.

In an image forming device relating to an eleventh aspect of the present invention, in the image forming device relating to the first aspect, plural abutment members are provided with intervals therebetween in a transverse direction of the recording medium.

In accordance with the above-described structure, plural abutment members are provided with intervals therebetween in the transverse direction of the recording medium. Therefore, the recording medium can effectively hit the abutment members at the proper posture, as compared with a case in which an abutment member is provided only at the central side in the transverse direction of the recording medium.

In an image forming device relating to a twelfth aspect of the present invention, in the image forming device relating to the first aspect, plural supporting/conveying members are provided with intervals therebetween in a transverse direction of the recording medium that is conveyed.

In accordance with the above-described structure, because plural supporting/conveying members are provided with intervals therebetween in the transverse direction of the recording medium that is conveyed, the recording medium can be corrected to the proper posture effectively, as compared with a case in which one supporting/conveying member is provided at the central side.

In an image forming device relating to a thirteenth aspect of the present invention, in the image forming device relating to the twelfth aspect, guiding members, that guide the recording medium that is conveyed while supporting the recording medium from a bottom side, are provided between the respective supporting/conveying members and at outer sides of the supporting/conveying members that are disposed at outermost sides in the transverse direction of the recording medium, and restricting members, that restrict floating of the recording medium that is conveyed, are provided in the transverse direction of the recording medium with respect to the pushing roller, so as to face the guiding members.

In accordance with the above-described structure, the restricting members, that are provided in the transverse direction of the recording medium with respect to the pushing roller, restrict floating of the recording medium that is conveyed. Therefore, floating in the height direction, that arises at the recording medium due to the pushing roller attempting to push the recording medium against the abutment member, can be suppressed.

In an image forming device relating to a fourteenth aspect of the present invention, in the image forming device relating to the thirteenth aspect, a distance (h [mm]) between the restricting member and a guide surface of the guiding member that is disposed so as to face the restricting member, is set to be smaller than a distance (Td [mm]) between the droplet ejecting head and a supporting surface that is disposed so as to oppose the droplet ejecting head and that supports the recording medium that is conveyed ($h<Td$).

In accordance with the above-described structure, because h [mm] is set to be smaller than Td [mm], the recording medium, that is conveyed while being supported at the supporting surface, rubbing against the droplet ejecting head can be suppressed.

In accordance with the present invention, a recording medium can hit an abutment member at a proper posture, even if the recording medium is wavy.

DETAILED DESCRIPTION OF THE INVENTION

Figure 1:
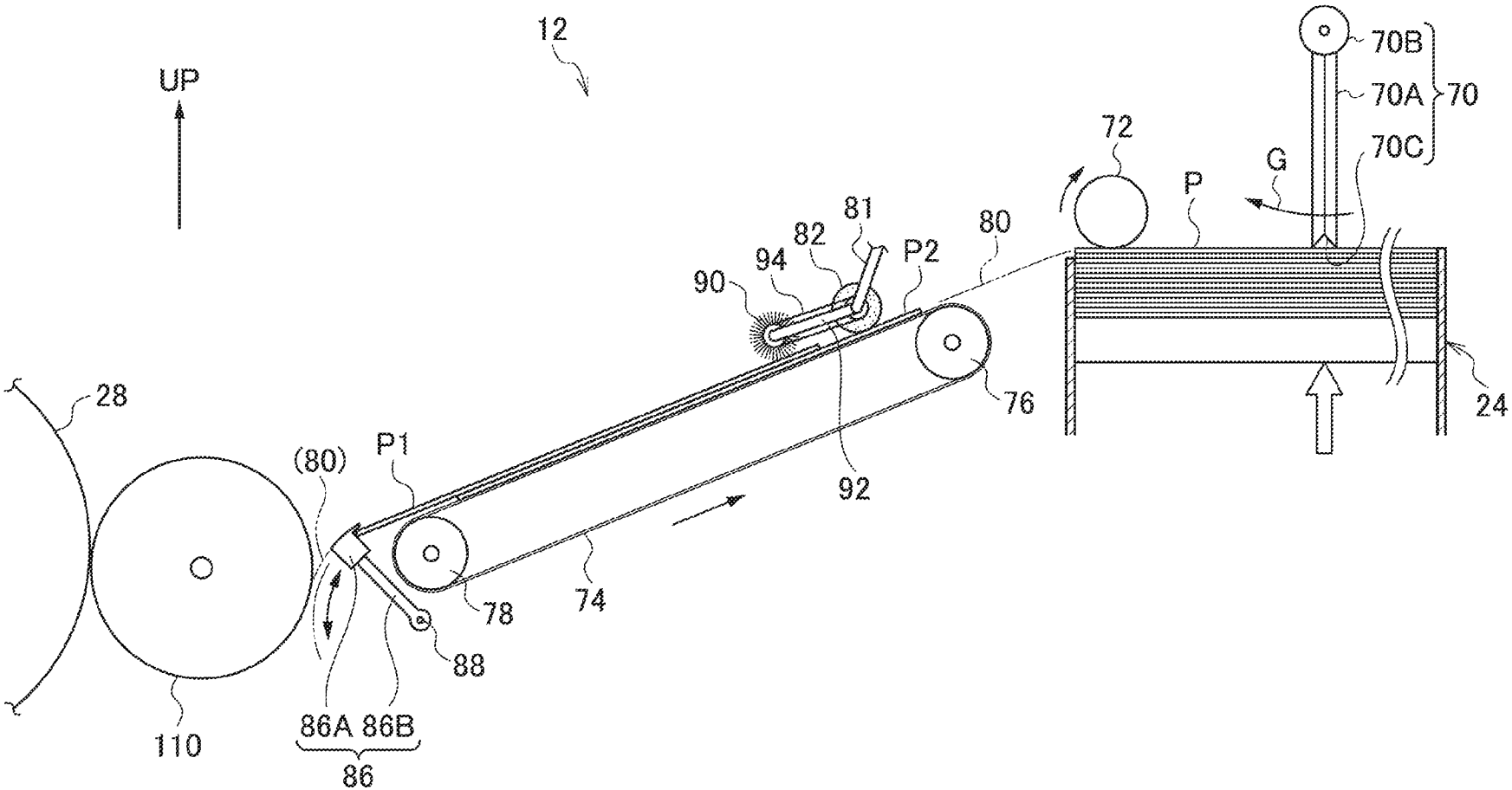
FIG. 1 is a cross-sectional view showing a vicinity of a pushing roller of a sheet feeding section employed in an image forming device relating to an exemplary embodiment of the present invention.

An example of an image forming device 10 relating to an exemplary embodiment of the present invention is described in accordance with FIG. 1 through FIG. 9. Note that arrow UP in the drawings indicates upward in the vertical direction.

(Overall Structure)

Figure 9:
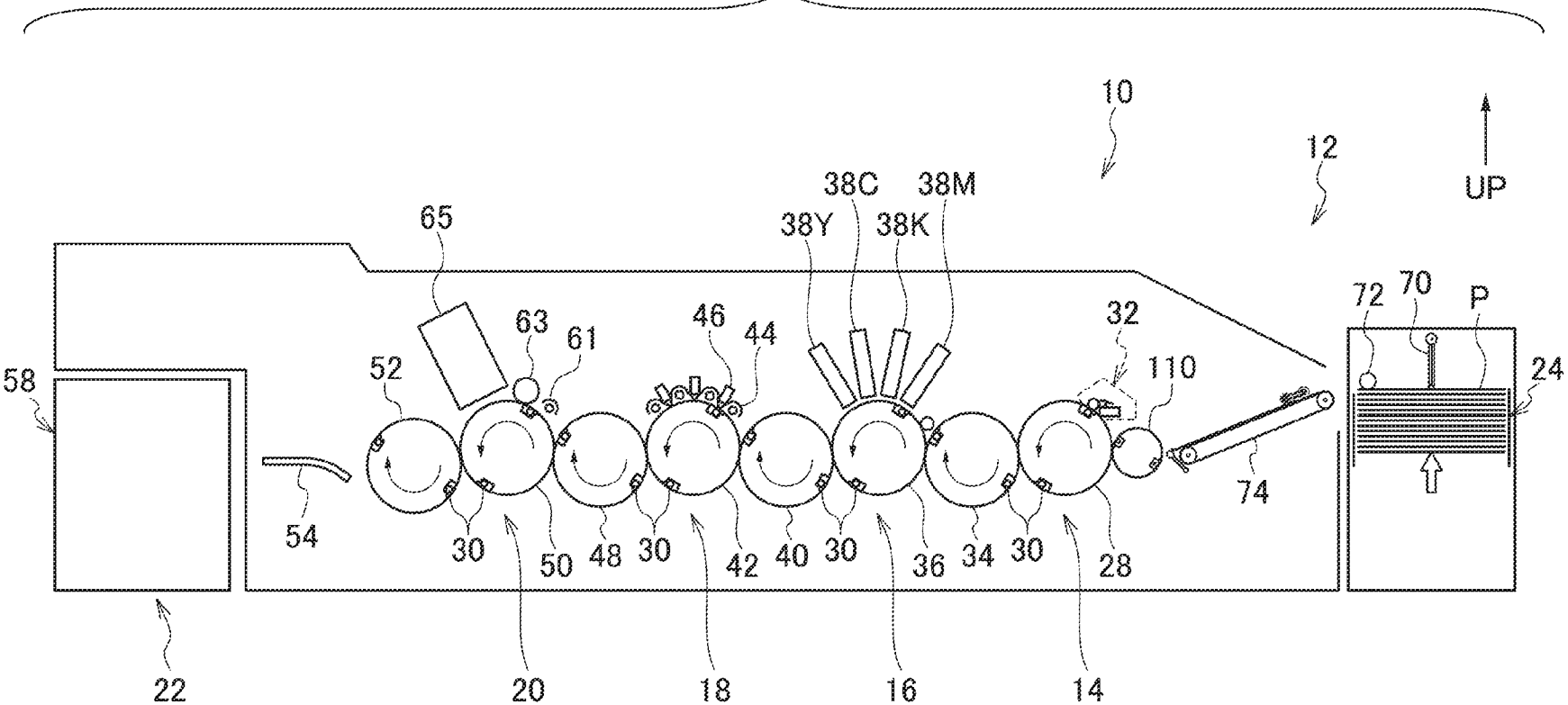
FIG. 9 is a schematic structural drawing showing the image forming device relating to the exemplary embodiment of the present invention.

As shown in FIG. 9, the image forming device 10 has a sheet feeding section 12 that supplies a sheet member P that serves as a recording medium, a processing liquid coating section 14 that coats a processing liquid on the image formation surface of the sheet member P, an image recording section 16 that forms an image on the sheet member P, a drying section 18 that reduces the moisture of (dries) the sheet member P in order to strengthen the film quality of the drawn portions at which the image is formed, a fixing section 20 that fixes the formed image onto the sheet member P, and a discharge section 22 into which the sheet member P is discharged.

At the sheet feeding section 12, the sheet members P are fed-out one-by-one from a sheet feed tray 24, in which the sheet members P are stacked, toward the processing liquid coating section 14 that is provided at the downstream side in the conveying direction of the sheet member P (hereinafter, simply called conveying direction). Note that the structure of the sheet feeding section 12 is described in detail later.

Further, a processing liquid coating drum 28, that, while rotating, receives the sheet member P conveyed by the sheet feeding section 12 and conveys the sheet member P along the outer peripheral surface thereof, is provided at the processing liquid coating section 14. In detail, holding members 30, that nip and hold the leading end portion of the sheet member P, are provided at the outer peripheral surface of the processing liquid coating drum 28.

Due to this structure, the sheet member P is, in a state in which the leading end thereof is held by the holding member 30, conveyed along the outer peripheral surface of the processing liquid coating drum 28 toward the downstream side in the conveying direction, due to the rotation of the processing liquid coating drum 28.

Note that these holding members 30 are similarly provided also at a conveying drum 34, an image recording drum 36, a conveying drum 40, a drying drum 42, a conveying drum 48 and a fixing drum 50 that are described later.

A processing liquid coating device 32, that coats processing liquid onto the image formation surface of the sheet member P that is conveyed along the outer peripheral surface of the processing liquid coating drum 28, is provided at the upper side, in the vertical direction, of the processing liquid coating drum 28. Note that the processing liquid has the effect of reacting with droplets, that are described later, and aggregating color materials (pigments), and promoting separation of the color materials (pigments) and solvents.

Moreover, the conveying drum 34 that, while rotating, receives at the holding member 30 the sheet member P conveyed by the processing liquid coating drum 28 and conveys the sheet member P toward the image recording section 16, is provided at the downstream side in the conveying direction with respect to the processing liquid coating drum 28.

The image recording drum 36 that, while rotating, receives at the holding member 30 the sheet member P conveyed by the conveying drum 34 and conveys the sheet member P along the outer peripheral surface of the image recording drum 36, is provided at the image recording section 16. Further, droplet ejecting heads 38, that eject droplets of inks or the like onto the sheet member P that is conveyed along the outer peripheral surface of the image recording drum 36 and form an image on the image formation surface of the sheet member P, are provided at the upper side, in the vertical direction, of the image recording drum 36.

The droplet ejecting heads 38 are provided so as to extend along the transverse direction of the sheet member P that is conveyed, and have ink ejection ranges that correspond to the maximum width of the sheet member P, i.e., are full-line heads. Note that, in the present exemplary embodiment, as an example, the droplet ejecting heads 38 of the four colors of Y (yellow), M (magenta), C (cyan), K (black) that are basic colors are disposed along the peripheral direction of the image recording drum 36.

Moreover, the conveying drum 40 that, while rotating, receives at the holding member 30 the sheet member P conveyed by the image recording drum 36 and conveys the sheet member P toward the drying section 18, is provided at the downstream side in the conveying direction with respect to the image recording drum 36.

The drying drum 42 that, while rotating, receives at the holding member 30 the sheet member P conveyed by the conveying drum 40 and conveys the sheet member P along the outer peripheral surface of the drying drum 42, is provided at the drying section 18. Further, halogen heaters 44 and warm air nozzles 46, that are used in order to dry the sheet member P that is conveyed along the outer peripheral surface of the drying drum 42, are disposed at the upper side, in the vertical direction, of the drying drum 42. Due to this structure, while the sheet member P is conveyed by the drying drum 42, the moisture that is contained in the sheet member P is reduced (dried) by the heat from the halogen heaters 44 and the warm air from the warm air nozzles 46, in order to strengthen the film quality of the drawn portions at which the image is formed. Due thereto, the film quality strength of the image formed on the sheet member P improves.

Moreover, the conveying drum 48 that, while rotating, receives at the holding member 30 the sheet member P conveyed by the drying drum 42 and conveys the sheet member P toward the fixing section 20, is provided at the downstream side in the conveying direction with respect to the drying drum 42.

The fixing drum 50 that, while rotating, receives at the holding member 30 the sheet member P conveyed by the conveying drum 48 and conveys the sheet member P along the outer peripheral surface of the fixing drum 50, is provided at the fixing section 20. A halogen heater 61 that is used in order to heat (preliminarily heat) the image formation surface of the sheet member P that is conveyed, a fixing roller 63 that causes the sheet member P to contact under pressure the outer peripheral surface of the fixing drum 50, and an in-line sensor 65 that measures a check pattern on the sheet member P and the amount of moisture, the surface temperature, the glossiness and the like, are provided in that order so as to face the outer peripheral surface of the fixing drum 50.

Moreover, a conveying drum 52 that, while rotating, receives at the holding member 30 the sheet member P conveyed by the fixing drum 50, and further, discharges the sheet member P out to the discharge section 22 along a curved guide plate 54, is provided at the downstream side in the conveying direction with respect to the drying drum 50.

A seasoning device 58, that causes the sheet member P to become accustomed to the surrounding environment, is provided at the discharge section 22 into which the sheet member P is discharged by the conveying drum 52.

Due to the above-described structure, as shown in FIG. 9, the processing liquid coating drum 28 receives, at the holding member 30, the sheet member P that is supplied by the sheet feeding section 12, and conveys the sheet member P along the outer peripheral surface of the processing liquid coating drum 28. Then, the processing liquid coating device 32 coats processing liquid on the image formation surface of the sheet member P that is conveyed along the outer peripheral surface of the processing liquid coating drum 28.

Further, the sheet member P, on which the processing liquid has been coated, is transferred to the conveying drum 34 that rotates, and is conveyed along the outer peripheral surfaces of the conveying drum 34 and the image recording drum 36 that rotate. At the image recording section 16, the droplet ejecting heads 38 of the respective colors eject droplets of inks or the like onto the image formation surface of the sheet member P that is conveyed along the outer peripheral surface of the image recording drum 36, and form an image on the sheet member P.

Moreover, the sheet member P, on whose image formation surface an image has been formed, is transferred to the conveying drum 40 that rotates, and is conveyed along the outer peripheral surfaces of the conveying drum 40 and the drying drum 42 that rotate. At the drying section 18, the sheet member P that is conveyed along the outer peripheral surface of the drying drum 42 is dried by the heat of the halogen heaters 44 and the warm air blown-out from the warm air nozzles 46. Namely, by reducing (drying) the moisture contained in the sheet member P, the film quality of the drawn portions at which the image is formed is strengthened.

Further, the sheet member P, that has been made to be a high temperature by the heat of the halogen heaters 44 and the warm air blown-out from the warm air nozzles 46, is transferred to the conveying drum 48 that rotates, and is conveyed along the outer peripheral surfaces of the conveying drum 48 and the fixing drum 50 that rotate. At the fixing section 20, the halogen heater 61, that is provided so as to face the fixing drum 50, fixes, on the sheet member P and by heat, the image formed on the sheet member P. Further, the sheet member P that is conveyed by the fixing drum 50 is made by the fixing roller 63 to contact under pressure the fixing drum 50, and passes the portion facing the in-line sensor 65. The in-line sensor 65 measures the check pattern on the passing sheet member P, and the amount of moisture, the surface temperature, the glossiness, and the like.

Moreover, the sheet member P, that has been measured by the in-line sensor 65, is transferred to the conveying drum 52, and is discharged along the guide plate 54 to the seasoning device 58 that is provided at the discharge section 22. The sheet member P that is discharged to the seasoning device 58 becomes accustomed to the peripheral environment due to air being blown thereon or the like.

(Structure of Main Portions)

The structure of the sheet feeding section 12 is described next.

As shown in FIG. 1, the sheet feed tray 24 in which the sheet members P are stacked is provided at the sheet feeding section 12. Suckers 70, that separate one-by-one the sheet members P that are stacked in the sheet feed tray 24, are provided at the upper side, in the vertical direction, of the sheet feed tray 24.

In further detail, two of the suckers 70 are provided with an interval therebetween in the transverse direction of the sheet member P (hereinafter simply called transverse direction). The sucker 70 has a main body 70A that is rod-shaped and extends in the vertical direction, a rotating shaft 70B that is provided at the vertical direction upper one end portion of the main body 70A and extends in the transverse direction, and a suction opening 70C that is provided at the other end portion of the main body 70A and at which suction force is generated.

Due to the above-described structure, the sheet member P that is stacked uppermost in the sheet feed tray is separated from the sheet member P at the lower side thereof by being sucked by the suction force generated at the other end portions of the main bodies 70A of the suckers 70 and by the main bodies 70A being moved in the form of an arc (refer to arrow G in the figure).

Figure 3:
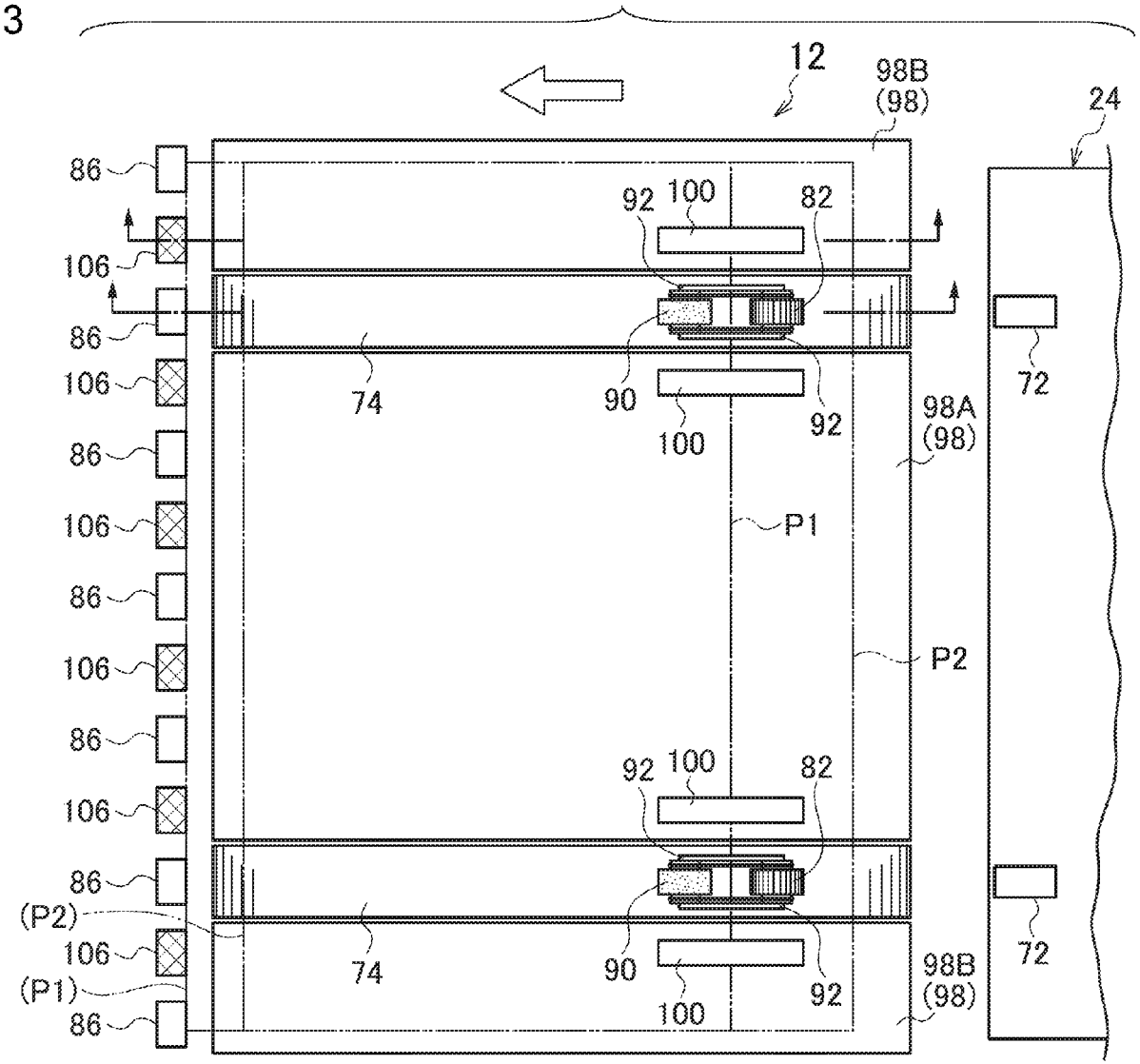
FIG. 3 is a plan view showing the sheet feeding section employed in the image forming device relating to the exemplary embodiment of the present invention.

Pick-up rollers 72 are provided next to the suckers 70 at an end portion side of the sheet member P that is stacked uppermost in the sheet feed tray 24. While rotating, the pick-up rollers 72 feed the uppermost sheet member P, that has been separated by the suckers 70, out toward the downstream side in the conveying direction along a conveying path 80 of the sheet member P. As shown in FIG. 3, in the same way as the suckers 70, two of the pick-up rollers 72 are disposed with an interval therebetween in the transverse direction.

A raising/lowering mechanism that raises and lowers the stacked sheet members P is provided at the sheet feed tray 24. When the uppermost sheet member P is fed-out, the stacked sheet members P are raised by the raising/lowering mechanism.

Further, as shown in FIG. 1 and FIG. 3, conveying belts 74, that are endless and serve as an example of supporting/conveying members, are respectively provided at the conveying direction downstream sides of the respective pick-up rollers 72. The conveying belts 74 are disposed so as to extend toward the downstream side in the conveying direction, and are trained around driving rollers 76 that are driven to rotate, and driven rollers 78 that are rotatably supported at the device main body.

Due thereto, the sheet member P, that is fed-out by the pick-up rollers 72, is placed on the belt surfaces of the conveying belts 74 and conveyed toward the downstream side in the conveying direction.

Conveying rollers 82, that are rotatably supported at stays 81 that extend from unillustrated frame members, are provided at the side of the sheet member P that is being conveyed, which side is at opposite the side at which the conveying belts 74 are located. Due to these conveying rollers 82 contacting the sheet member P, that is conveyed by the conveying belts 74 that circulate, and being slave-rotated by frictional force, the conveying rollers 82 convey the sheet member P along the conveying path 80.

Moreover, abutment members 86, that the leading end portion of the sheet member P abuts and that stop the leading end portion of the sheet member P at a prescribed position, are provided at the downstream side in the conveying direction with respect to the conveying belts 74. Further, the conveying rollers 82 are disposed such that the conveying rollers 82 and the trailing end portion of the sheet member P (P1 shown in the respective drawings), whose leading end portion abuts the abutment members 86, are apart from one another.

As shown in FIG. 3, the plural abutment members 86 are disposed with intervals therebetween in the transverse direction. Moreover, as shown in FIG. 1, the abutment member 86 has an abutment portion 86A that the leading end portion of the sheet member P abuts, and a swinging portion 86B to whose one end portion the abutment portion 86A is fixed and at whose other end portion a rotation shaft 88 is formed and that is supported so as to be swingable.

Due to this structure, after the leading end portion hits the abutment portions 86A of the abutment members 86 and the sheet member P is stopped at a prescribed position, the abutment members 86 swing and withdraw from the conveying path 80, and the stopped state by the abutment members 86 is cancelled.

On the other hand, as shown in FIG. 1, pushing rollers 90, that push the leading end portion of the sheet member P against the abutment portions 86A of the abutment members 86 by rotating while contacting the trailing end side of the sheet member P, are provided on the conveying path 80 between the conveying rollers 82 and the abutment members 86.

Figure 4A:
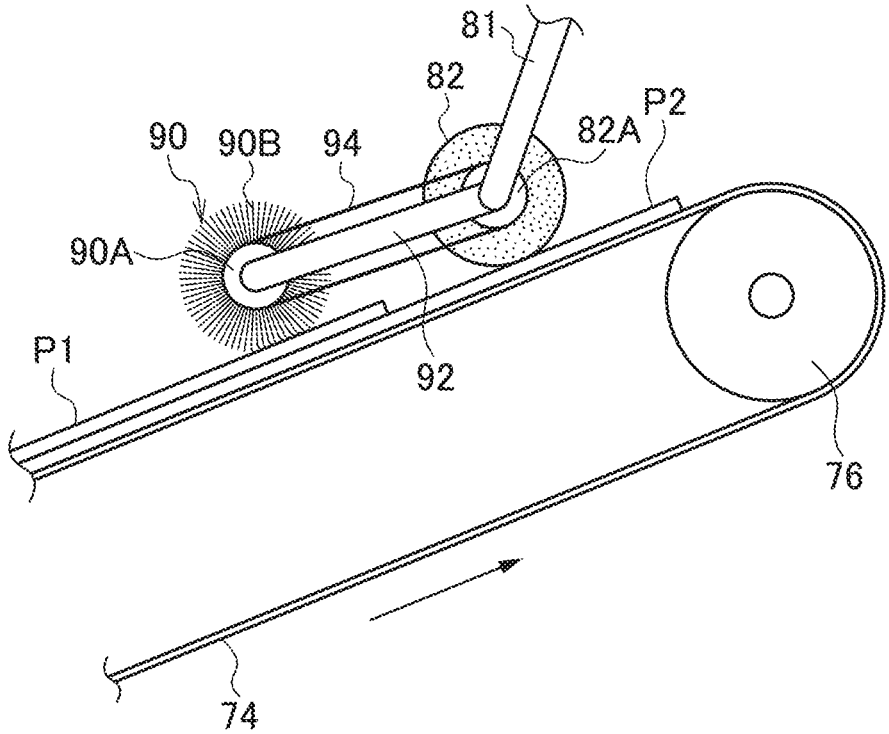
FIGS. 4A and 4B are enlarged sectional views showing a vicinity of the pushing roller and a vicinity of the restricting member of the sheet feeding section employed in the image forming device relating to the exemplary embodiment of the present invention.
Figure 5:
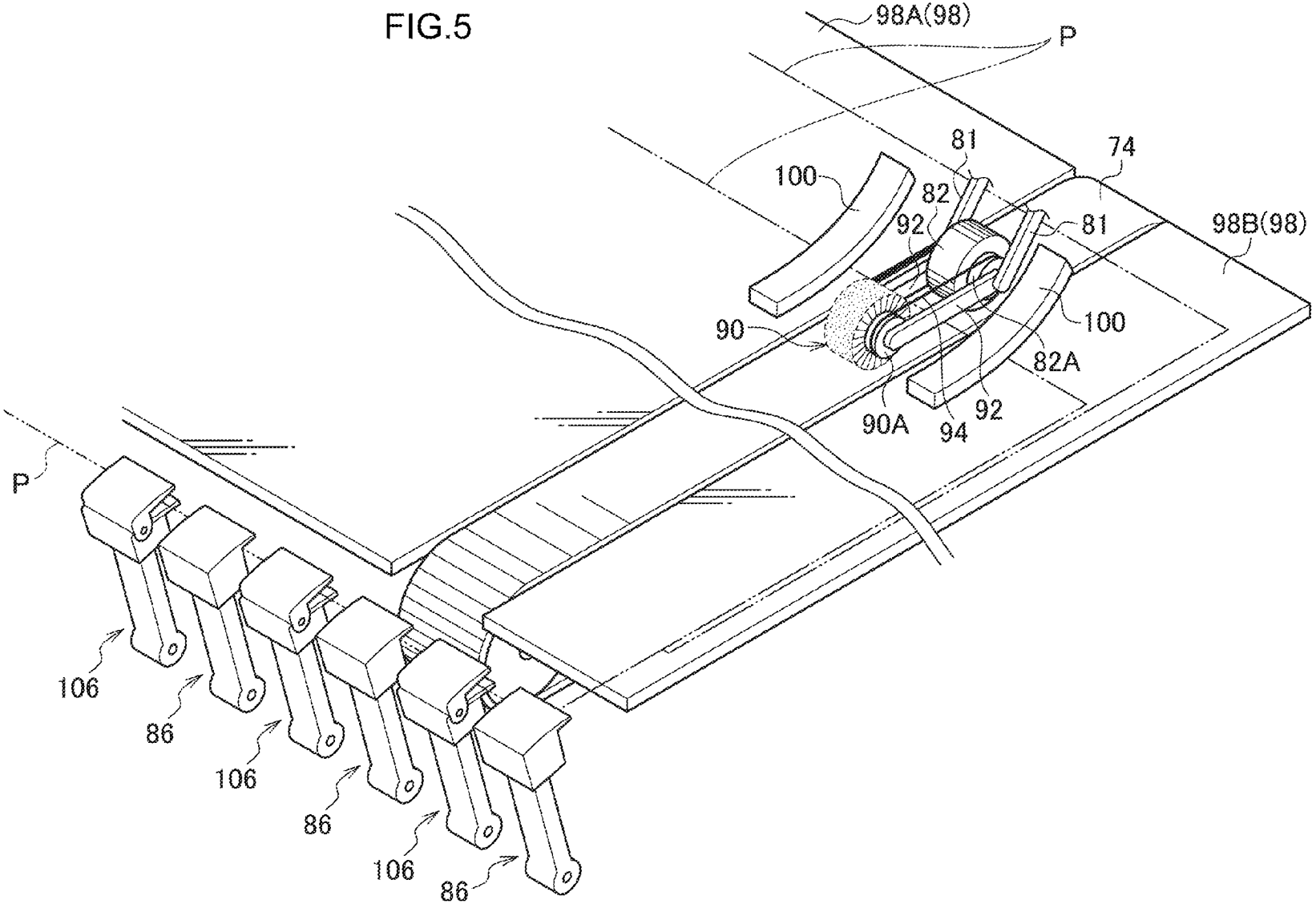
FIG. 5 is a perspective view showing the pushing roller and a vicinity of the restricting members of the sheet feeding section employed in the image forming device relating to the exemplary embodiment of the present invention.

In further detail, as shown in FIG. 1, FIG. 4A and FIG. 5, the pushing roller 90 is a so-called brush roller, and is structured to include a rotating shaft 90A of the pushing roller 90, and plural flexible fibers 90B that serve as an example of flexible elongated members that spread out in a radial form in the radial direction from the rotating shaft of the pushing roller.

Further, supporting members 92, that rotatably support the rotating shaft 90A of the pushing roller 90 and a rotating shaft 82A of the conveying roller 82, are provided, and the pushing roller 90 can swing around the rotating shaft 82A of the conveying roller 82. Due thereto, the pushing roller 90 is, by its own weight, pushed against the conveying belt 74.

An endless belt 94, that is endless and serves as an example of a transmission member, is trained around the rotating shaft 82A and the rotating shaft 90A. The rotational force of the conveying roller 82 is transferred through the endless belt 94 to the pushing roller 90. In this way, differently than the conveying roller 82, the pushing roller 90 is not structured so as to be slave-rotated with respect to the conveying belt 74, and therefore, the nipping force (the nipping force that nips-in the sheet member P) that is generated between the pushing roller 90 and the conveying belt 74 is weaker than the nipping force that is generated between the conveying roller 82 and the conveying belt 74.

On the other hand, as shown in FIG. 3 and FIG. 5, a guiding member 98, that is plate-shaped and guides the sheet member P, that is conveyed by the conveying belts 74, while supporting the sheet member P from the lower side thereof, is provided at both sides in the transverse direction with respect to the respective conveying belts 74. Concretely, the guiding member 98 is structured from a guiding member 98A that is disposed between the pair of conveying belts 74, and guiding members 98B that are disposed at the transverse direction outer sides of the conveying belts 74.

Figure 2:
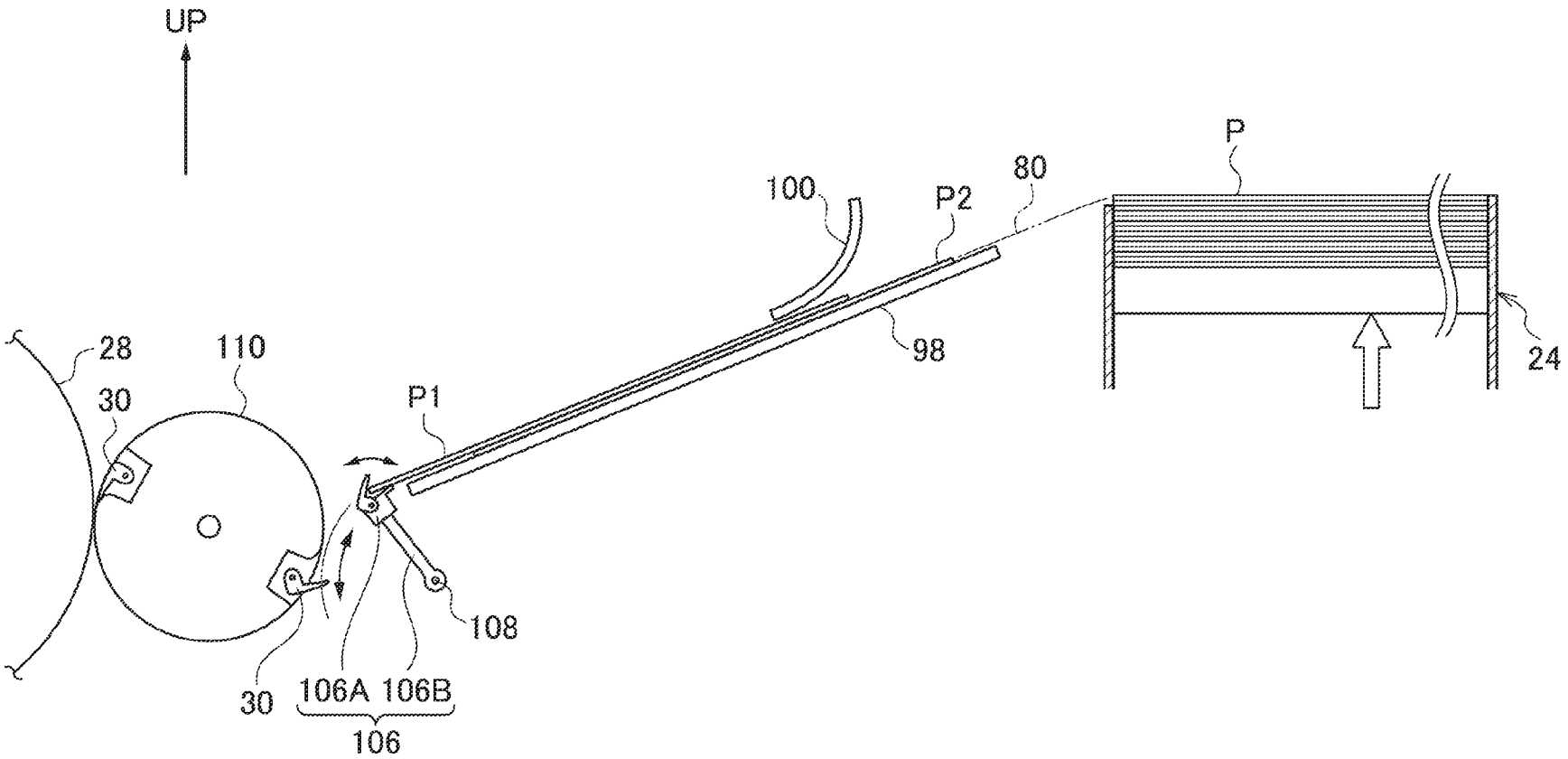
FIG. 2 is a cross-sectional view showing a vicinity of a restricting member of the sheet feeding section employed in the image forming device relating to the exemplary embodiment of the present invention.

Further, as shown in FIG. 2 and FIG. 3, restricting members 100, that restrict the floating-up of the sheet member P that is being conveyed, are provided at both sides in the transverse direction with respect to the respective pushing rollers 90, so as to face the guiding member 98.

Figure 4B:
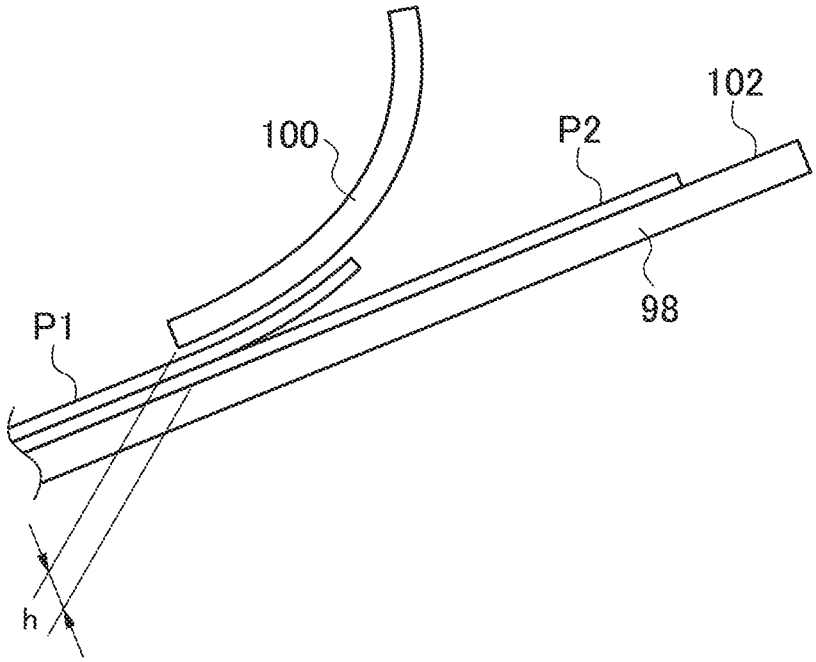

In further detail, as shown in FIG. 4B and FIG. 5, the restricting member 100 is a plate member that is molded in a curved shape such that the space between the restricting member 100 and the guiding member 98 gradually becomes more narrow toward the downstream side in the conveying direction.

Figure 8:
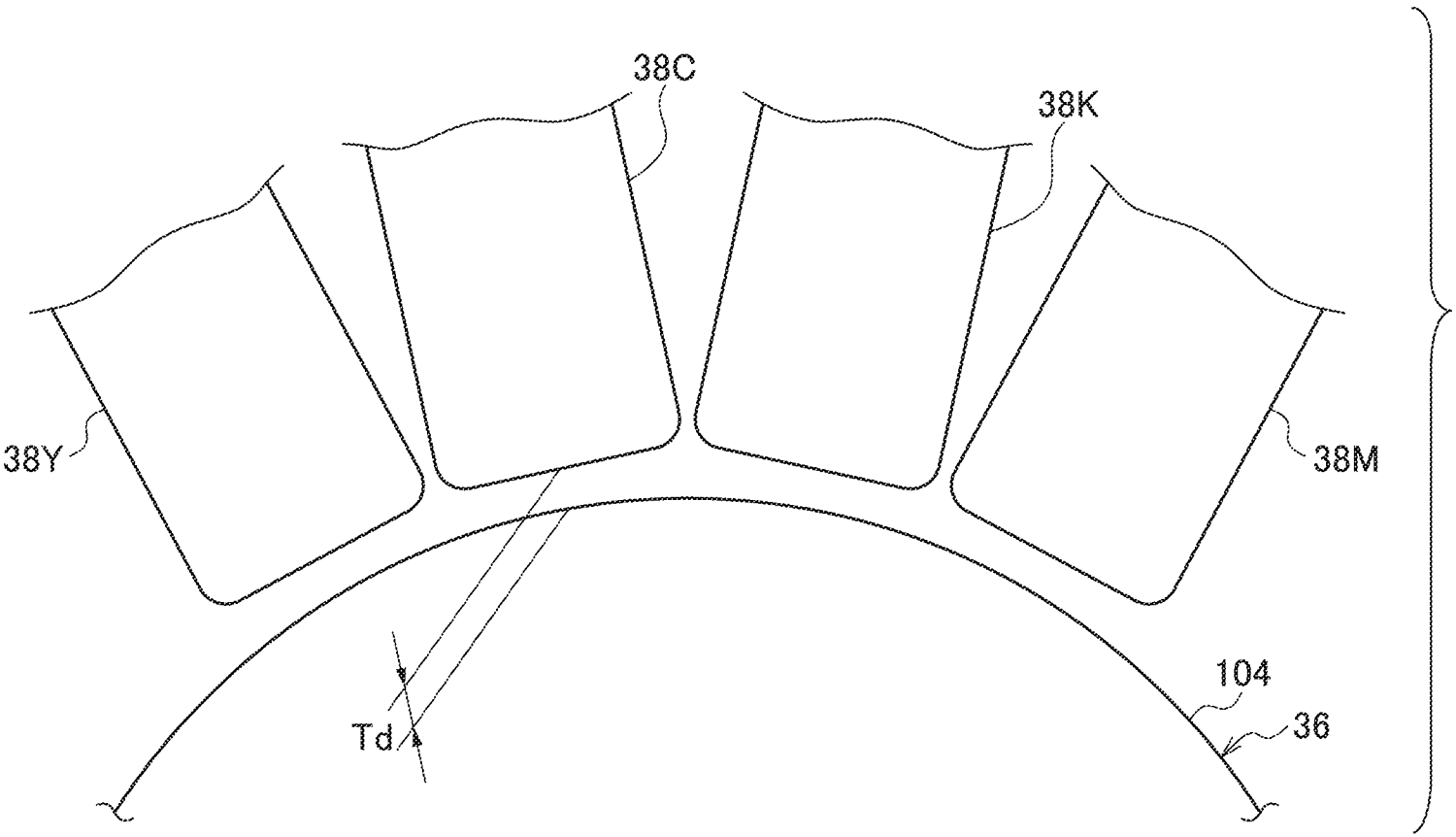
FIG. 8 is a side view showing the vicinity of droplet ejecting heads employed in the image forming device relating to the exemplary embodiment of the present invention.

Moreover, as shown in FIG. 4B, given that the distance between the conveying direction downstream side end portion of the restricting member 100 and a guide surface 102 of the guiding member 98 is h [mm], and further, that the distance between the droplet ejecting head 38 and a conveying surface 104, that is provided at the image recording drum 36 and that serves as an example of a supporting surface that supports the sheet member P, is Td [mm] as shown in FIG. 8, following relational expression (1) is satisfied.

$$0<h<Td \quad (1)$$

Namely, h [mm] is set to be smaller than Td [mm].

Further, as shown in FIG. 3 and FIG. 5, plural conveying members 106 that convey the sheet member P, whose leading end portion has been stopped by the abutment members 86, toward the downstream side in the conveying direction, are provided between the adjacent abutment members 86.

In further detail, as shown in FIG. 2, the conveying member 106 has a grasping portion 106A that grasps the leading end portion of the sheet member P, and a swinging portion 106B to whose one end portion the grasping portion 106A is fixed and at whose other end portion a rotation shaft 108 is formed and that is supported so as to be swingable.

Due to this structure, after the grasping portions 106A grasp the leading end portion of the sheet member P and the abutment portions 86A withdraw from the conveying path 80 (refer to FIG. 6C), the conveying members 106 swing, and convey the sheet member P toward the downstream side in the conveying direction.

Further, a conveying drum 110 is provided at the downstream side in the conveying direction with respect to the conveying members 106. While rotating, the conveying drum 110 receives at the holding member 30 the sheet member P conveyed by the conveying members 106, and conveys the sheet member P toward the processing liquid coating section 14 (refer to FIG. 9).

(Operation/Effects of Structures of Main Portions)

The operation and effects of the sheet feeding section 12 are described next.

As shown in FIG. 1 and FIG. 2, the suckers 70 suck the sheet member P, that is stacked uppermost in the sheet feed tray 24, by the suction force that is generated at the other end portions of the main bodies 70A. In this state, the main bodies 70A of the suckers 70 swing in the arrow G direction around the rotating shafts 70B, and the uppermost sheet member P that is sucked is separated from the other sheet members P.

Further, while rotating, the pick-up rollers 72 feed the uppermost sheet member P, that has been separated by the suckers 70, out toward the downstream side in the conveying direction along the conveying path 80.

The sheet member P, that has been fed-out by the pick-up rollers 72, is conveyed toward the downstream side in the conveying direction while being nipped by the belt surfaces of the conveying belts 74 that circulate and the conveying rollers 82.

Further, the pushing rollers 90, that rotate by rotational force being transferred thereto from the conveying rollers 82, rotate and push the leading end portion of the sheet member P (P1 shown in the respective drawings) against the abutment members 86, while contacting the trailing end side of the sheet member P at which floating-up is restricted by the restricting members 100. Concretely, the pushing rollers 90 rotate while sliding on the sheet member P, without being slave-rotated with respect to the conveying belts 74 (also including cases of being slave-rotated via the sheet member P) and in a state in which the flexible fibers 90B abut the sheet member P and flex. Namely, the rotational force of the conveying rollers 82 is transferred through the endless belts 94 to the pushing rollers 80, and the pushing rollers 90, that rotate due to this rotational force, rotate while sliding on the sheet member P, and push the leading end portion of the sheet member P against the abutment members 86. The pushing rollers 90 continue to rotate also at the time when the leading end portion of the sheet member P has hit the abutment members 86 and is stationary. Due thereto, the leading end portion of the sheet member P soundly hits the plural abutment members 86, and becomes uniform (aligned) in the transverse direction of the sheet member P. Namely, the leading end portion of the sheet member P hits the abutment members 86 at the proper posture in which the leading end portion is uniform (aligned) in the transverse direction and the sheet member P is not tilted with respect to the conveying direction of the sheet member P.

Figure 7A:
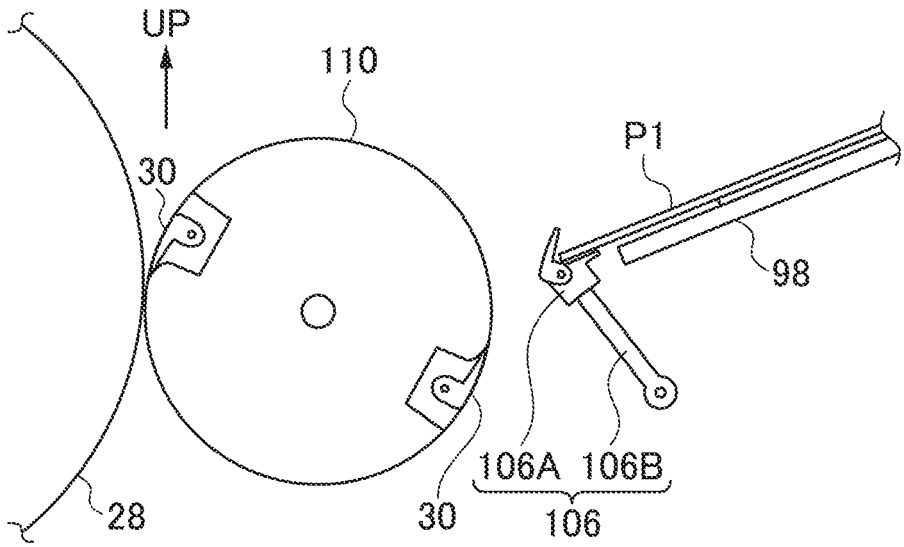
FIGS. 7A, 7B, 7C and 7D are operation explanation drawings that explain operation of a conveying member of the sheet feeding section employed in the image forming device relating to the exemplary embodiment of the present invention.
Figure 7B:
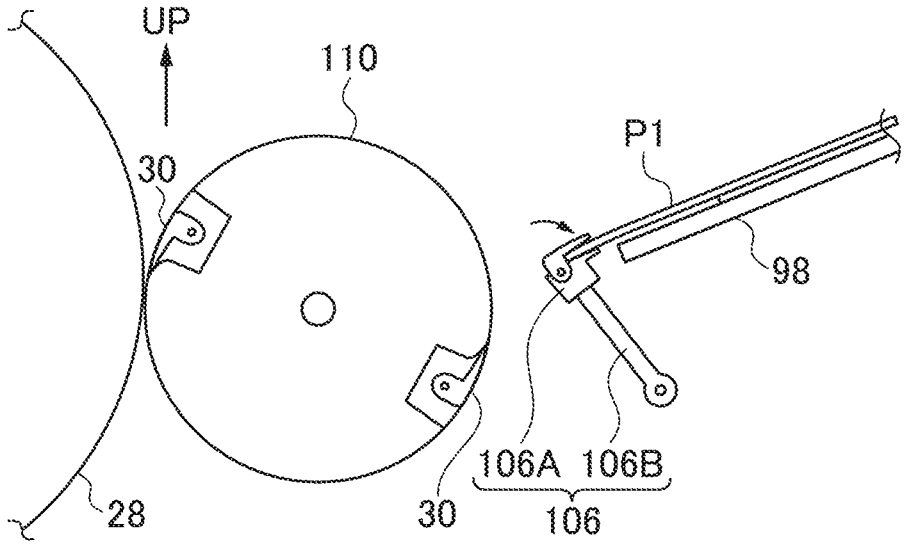

As shown in FIGS. 7A and 7B, when the leading end portion of the sheet member P is uniform in the transverse direction, the grasping portions 106A of the conveying members 106 grasp the leading end portion of the sheet member P.

Figure 6A:
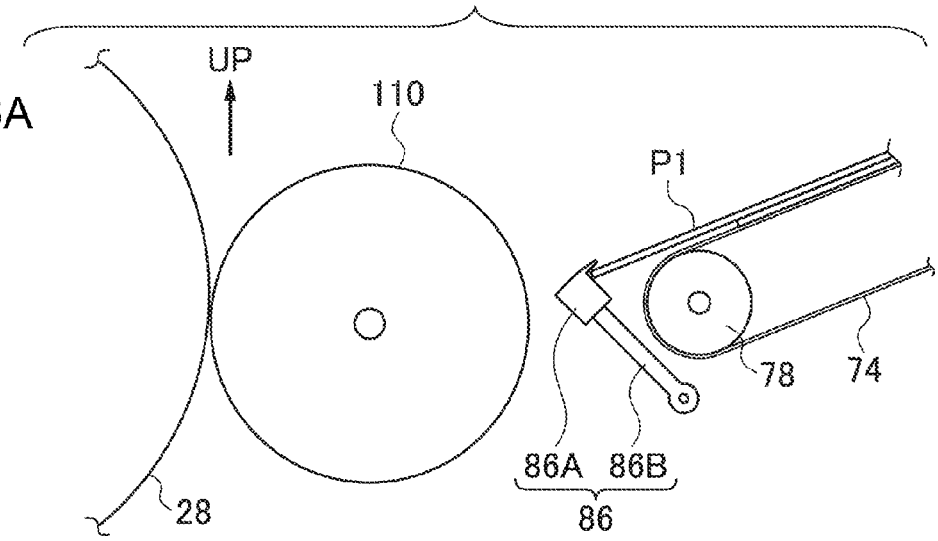
FIGS. 6A, 6B and 6C are operation explanation drawings that explain operation of an abutment member of the sheet feeding section employed in the image forming device relating to the exemplary embodiment of the present invention.
Figure 6B:
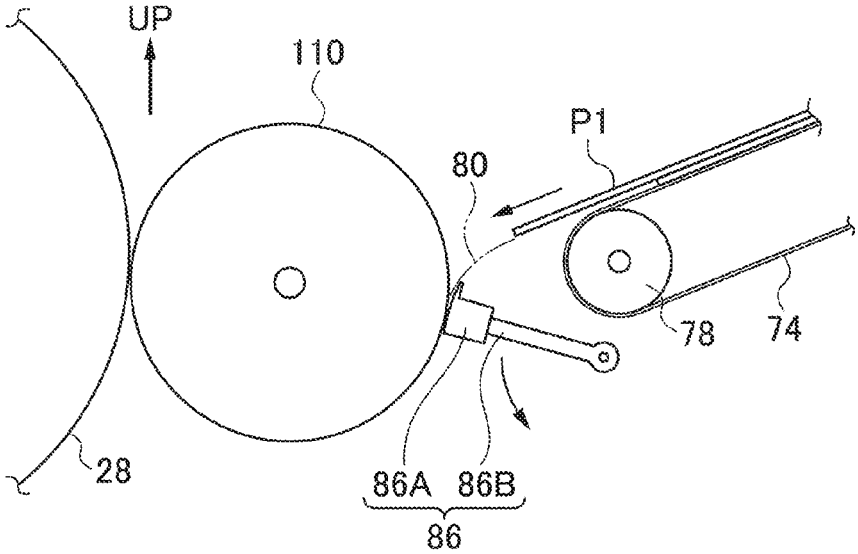
Figure 6C:
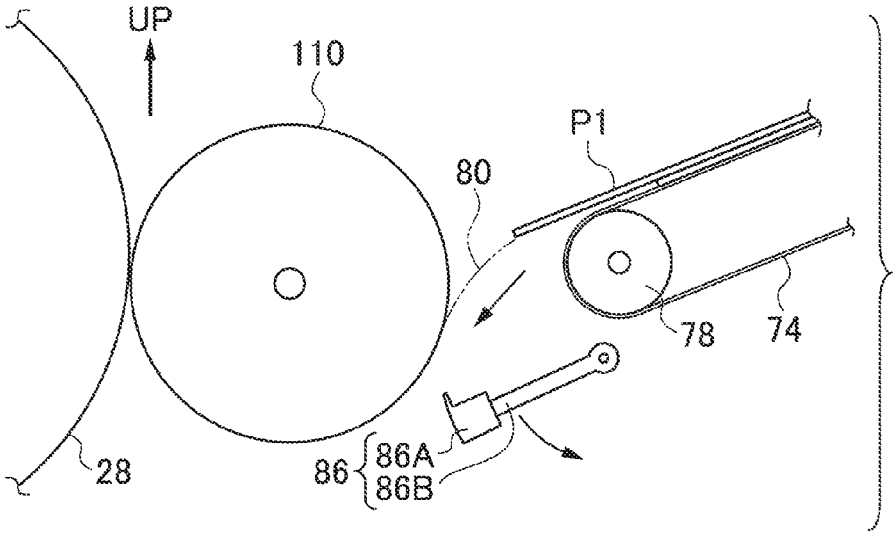

Further, as shown in FIGS. 6A, 6B and 6C, when the grasping portions 106A grasp the leading end portion of the sheet member P, the abutment members 86 swing and withdraw from the conveying path 80, and the stopped state by the abutment members 86 is thereby cancelled.

Figure 7C:
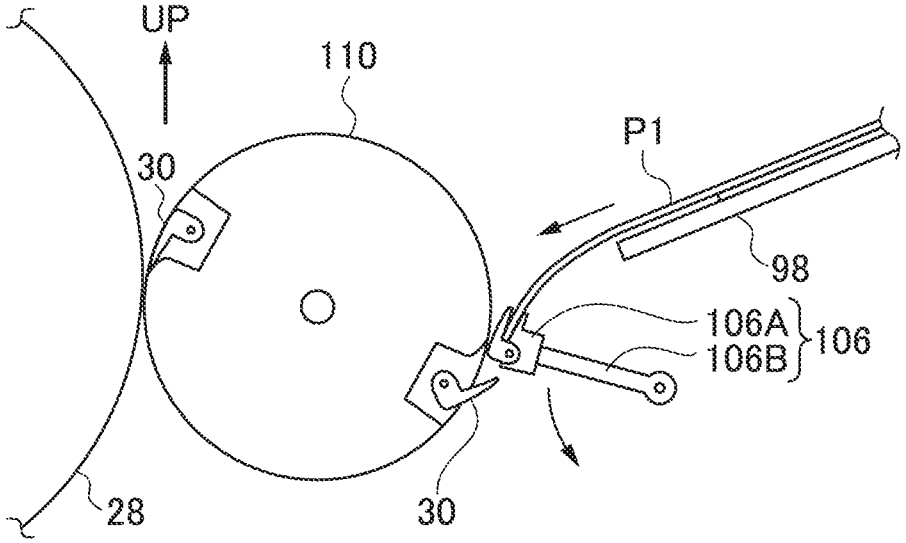
Figure 7D:
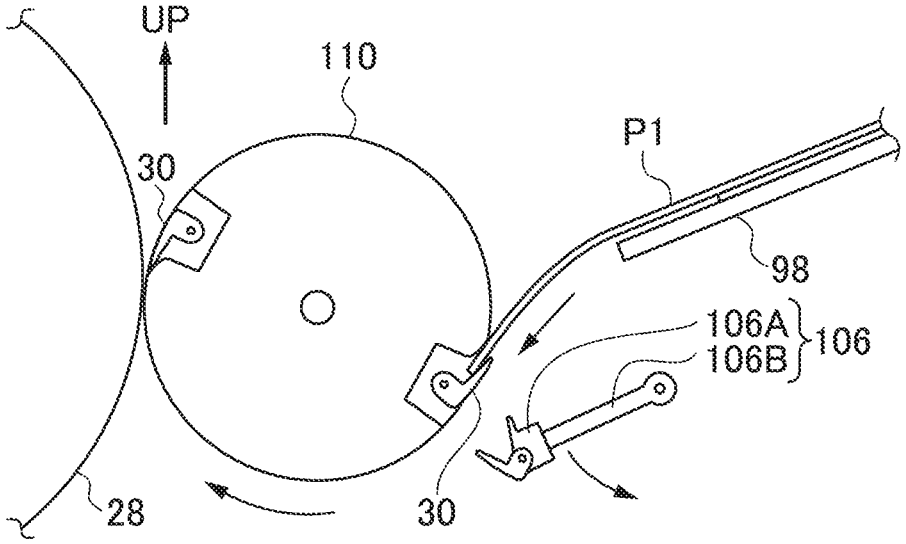

As shown in FIGS. 7C and 7D, when the abutment members 86 withdraw from the conveying path 80, the conveying members 106, that are grasping the leading end portion of the sheet member P at the grasping portions 106A, swing, and convey the sheet member P toward the downstream side in the conveying direction. Further, while rotating, the conveying drum 110 receives the sheet member P at the holding member 30 from the conveying members 106.

Then, the conveying drum 110 that rotates conveys the sheet member P along the outer peripheral surface thereof, and transfers the sheet member P to the processing liquid coating drum 28.

On the other hand, as shown in FIG. 1 and FIG. 2, in the state in which the leading end portion of the sheet member P (P1 shown in the respective drawings) is pushed against the abutment members 86, the second sheet member P (P2 shown in the respective drawings), that is fed-out to the conveying path 80 by the pick-up rollers 72, is conveyed while entering-in beneath the first sheet member P (P1 shown in the respective drawings).

Further, when images are to be formed on both surfaces (double-sided printing), the sheet feeding section 12 feeds the sheet member P, on whose one surface an image has been formed, out along the conveying path 80 in the same way as described above.

As described above, also when the leading end portion of the sheet member P has abutted the abutment members 86 and is stationary, the pushing rollers 90 rotate and soundly push the leading end portion of the sheet member P against the abutment members 86 while contacting the sheet member P and sliding on the sheet member P. Therefore, even in the case of the sheet member P that is wavy due to an image being formed on one surface thereof, the sheet member P abuts the abutment members at the proper posture. Namely, the sheet member P can hit the abutment members 86 at the proper posture in which the leading end portion of the sheet member P is uniform (aligned) in the transverse direction and the sheet member P is not tilted with respect to the conveying direction of the sheet member P.

Further, the pushing rollers 90 rotate and push the leading end portion of the sheet member P against the abutment members 86, with the flexible fibers 90B being in a state of abutting the sheet member P and flexing. Due thereto, the nipping force generated between the pushing rollers 90 and the conveying belts 74 can be adjusted.

Moreover, the conveying rollers 82 rotate by being slave-driven with the conveying belts 74 that circulate, and rotational force is transferred from the conveying rollers 82 to the pushing rollers 90. Therefore, there is no need to provide a drive source used exclusively for rotating the pushing rollers 90 and the conveying rollers 82.

The nipping force that is generated between the pushing rollers 90 and the conveying belts 74 is weaker than the nipping force that is generated between the conveying rollers 82 and the conveying belts 74. Therefore, as compared with a case in which the nipping forces are the same, deformation of the sheet member P, whose leading end portion is pushed against the abutment members 86 by the pushing rollers 90, can be suppressed.

Further, because the pushing rollers 90 can swing around the rotating shafts 82A of the conveying rollers 82, the pushing rollers 90 are pushed against the conveying belts 74 by their own weight, and excessive nipping force being generated between the pushing rollers 90 and the conveying belts 74 can be suppressed.

Further, because the plural abutment members 86 are provided with intervals therebetween in the transverse direction, the sheet member P can effectively abut the abutment members 86 at the proper posture, as compared with a case in which an abutment member is provided only at the central side in the transverse direction.

Because the two conveying belts 74 are provided with an interval therebetween in the transverse direction, the sheet member P can effectively be corrected to the proper posture, as compared with a case in which one conveying belt 74 is provided at the central side.

Further, two of the conveying rollers 82, that rotate by being slave-driven with respect to the conveying belts 74, are disposed with an interval therebetween along the transverse direction. Therefore, tilting (skewing) of the sheet member P that is conveyed can be suppressed.

Moreover, because the guiding member 98 that guides the sheet member P that is conveyed is provided, the conveying posture of the sheet member P can be stabilized.

The restricting members 100, that are provided in the transverse direction with respect to the pushing rollers 90, restrict floating-up of sheet member P that is conveyed. Therefore, floating (deformation) in the height direction, that arises at the sheet member P due to the pushing rollers 90 attempting to push the sheet member P against the abutment members 86, can be suppressed. Namely, the trailing end of the sheet member P being kicked-up by the pushing rollers 90 can be suppressed.

Further, given that the distance between the restricting members 100 and the guide surface 102 is h [mm] and the distance between the droplet ejecting heads 38 and the conveying surface 104 is Td [mm], h [mm] is made to be smaller than Td [mm]. Therefore, for example, even if the trailing end portion of the sheet member P that is conveyed curls upward, floating-up of the sheet member P can be corrected to less than or equal to Td [mm], and the sheet member P rubbing against the droplet ejecting heads 38 can be suppressed.

Note that, although the present invention has been described in detail above with reference to a specific exemplary embodiment, the present invention is not limited to this embodiment, and it will be clear to those skilled in the art that other, various embodiments are possible within the scope of the present invention. For example, in the above-described exemplary embodiment, the pushing rollers 90 hit the trailing end side of the sheet member P whose leading end portion abuts the abutment members 86, but the present invention is not limited to the same, and the pushing rollers 90 may hit the central side or the front end side of the sheet member P.

Further, in the above-described exemplary embodiment, the nipping force that is generated between the pushing rollers 90 and the conveying belts 74 is adjusted due to the flexible fibers 90B being flexed. However, the aforementioned nipping force may be adjusted by setting elastic members that support the rotating shafts 90A of the pushing rollers 90 while expanding and contracting such that the pushing rollers 90 approach or move away from the conveying belts 74. Or, the aforementioned nipping force may be adjusted by setting interval adjusting members that move the rotating shafts 90A of the pushing rollers 90 and adjust the intervals between the conveying belts 74 and the pushing rollers 90.

Further, although two of the conveying belts 74 are provided in the above-described exemplary embodiment, the number of the conveying belts 74 is not particularly limited to two, and three or more may be provided.

Moreover, although two of the pushing rollers 90 are provided in the above-described exemplary embodiment, the number of the pushing rollers 90 is not particularly limited to two, and three or more may be provided.

Although rotational force is imparted to the pushing rollers 90 through the conveying rollers 82 in the above-described exemplary embodiment, the present invention is not particularly limited to the same, and other members may impart rotational force to the pushing rollers.

What is claimed is:

1. An image forming device comprising:

a supporting/conveying member that supports a sheet-shaped recording medium from a bottom surface of the recording medium, and conveys the recording medium while rotating;

an abutment member that abuts a leading end portion of the recording medium that is conveyed by the supporting/conveying member, and stops the leading end portion of the recording medium;

a pushing roller that is provided at an upstream side, in a conveying direction of the recording medium, with respect to the abutment member so as to face the supporting/conveying member, and pushes the leading end portion of the recording medium against the abutment member by rotating while contacting the recording medium and sliding on the recording medium;

a conveying member that conveys the recording medium, whose stoppage by the abutment member has been released, toward a downstream side in the conveying direction of the recording medium; and a droplet ejecting head that ejects droplets onto the recording medium that is conveyed by the conveying member, and forms an image on the recording mediums;

a conveying roller that is disposed at an upstream side, in the conveying direction of the recording medium, with respect to a trailing end portion of a recording medium whose leading end portion abuts the abutment member, and that rotates and conveys the recording medium along a conveying path of the recording medium, wherein, when viewed from a direction of a rotating shaft of the conveying roller, the pushing roller is configured to be swingably supported.

2. The image forming device of claim 1, further comprising an adjusting mechanism that adjusts nipping force by which the recording medium is nipped between the pushing roller and the supporting/conveying member.

3. The image forming device of claim 2, wherein the adjusting mechanism structures the pushing roller and includes a plurality of flexible elongated members that spread out in a radial form in a radial direction from a rotating shaft of the pushing roller.

4. The image forming device of claim 2, wherein the adjusting mechanism includes an elastic member that supports a rotating shaft of the pushing roller while expanding and contracting such that the pushing roller approaches or moves away from the supporting/conveying member.

5. The image forming device of claim 2, wherein the adjusting mechanism includes an interval adjusting member that moves a rotating shaft of the pushing roller and adjusts an interval between the supporting/conveying member and the pushing roller.

6. The image forming device of claim 1, further comprising a drive source that imparts rotational force to a rotating shaft of the pushing roller and rotates the pushing roller.

7. The image forming device of claim 6, further comprising:

a transmission member that transfers rotational force of the conveying roller to the pushing roller.

8. The image forming device of claim 1, further comprising a supporting mechanism that supports the pushing roller such that the pushing roller is, by its own weight, pushed against the supporting/conveying member.

9. The image forming device of claim 8, wherein the supporting mechanism includes a supporting member that, when viewed from a direction of a rotating shaft of the conveying roller, supports the pushing roller swingably with respect to the conveying roller.

10. The image forming device of claim 1, wherein the conveying roller rotates by being slave-driven with respect to the supporting/conveying member.

11. The image forming device of claim 1, wherein a plurality of the abutment members are provided with intervals therebetween in a transverse direction of the recording medium.

12. The image forming device of claim 1, wherein a plurality of the supporting/conveying members are provided with intervals therebetween in a transverse direction of the recording medium that is conveyed.

13. The image forming device of claim 12, wherein guiding members, that guide the recording medium that is conveyed while supporting the recording medium from a bottom side, are provided between the respective supporting/conveying members and at outer sides of the supporting/conveying members that are disposed at outermost sides in the transverse direction of the recording medium, and restricting members, that restrict floating of the recording medium that is conveyed, are provided in the transverse direction of the recording medium with respect to the pushing roller, so as to face the guiding members.

14. The image forming device of claim 13, wherein a distance, between the restricting member and a guide surface of the guiding member that is disposed so as to face the restricting member, is set to be smaller than a distance between the droplet ejecting head and a supporting surface that is disposed so as to oppose the droplet ejecting head and that supports the recording medium that is conveyed.

15. An image forming device comprising:

a supporting/conveying member that supports a sheet-shaped recording medium from a bottom surface of the recording medium, and conveys the recording medium while rotating;

an abutment member that abuts a leading end portion of the recording medium that is conveyed by the supporting/conveying member, and stops the leading end portion of the recording medium;

a pushing roller that is provided at an upstream side, in a conveying direction of the recording medium, with respect to the abutment member so as to face the supporting/conveying member, and pushes the leading end portion of the recording medium against the abutment member by rotating while contacting the recording medium and sliding on the recording medium;

a conveying member that conveys the recording medium, whose stoppage by the abutment member has been released, toward a downstream side in the conveying direction of the recording medium; and a droplet ejecting head that ejects droplets onto the recording medium that is conveyed by the conveying member, and forms an image on the recording medium, wherein a plurality of the supporting/conveying members are provided with intervals therebetween in a transverse direction of the recording medium that is conveyed, wherein guiding members, that guide the recording medium that is conveyed while supporting the recording medium from a bottom side, are provided between the respective supporting/conveying members and at outer sides of the supporting/conveying members that are disposed at outermost sides in the transverse direction of the recording medium, and restricting members, that restrict floating of the recording medium that is conveyed, are provided in the transverse direction of the recording medium with respect to the pushing roller, so as to face the guiding members, and wherein a distance, between the restricting member and a guide surface of the guiding member that is disposed so as to face the restricting member, is set to be smaller than a distance between the droplet ejecting head and a supporting surface that is disposed so as to oppose the droplet ejecting head and that supports the recording medium that is conveyed.

* * * * *